US005443324A

United States Patent [19]

Sullivan

[11] Patent Number: 5,443,324

[45] Date of Patent: Aug. 22, 1995

[54] PINNING SYSTEM FOR PREFABRICATED BARRIERS

[75] Inventor: Keith D. Sullivan, Bridgeport, Conn.

[73] Assignee: Waters Construction Co., Inc., New Milford, Conn.

[21] Appl. No.: 278,427

[22] Filed: Jul. 21, 1994

[51] Int. Cl.[6] ..... E01F 13/00

[52] U.S. Cl. ..... 404/6

[58] Field of Search ..... 404/6, 9; 256/3.1

[56] References Cited

U.S. PATENT DOCUMENTS 5,067,763 4/1991 Burgett ..... 404/6
5,149,224 9/1992 Smith ..... 404/6
5,156,485 10/1992 Ivey et al. ..... 256/13.1 X

*Primary Examiner*—William P. Neuder

*Attorney, Agent, or Firm*—Lerner, David, Littenberg, Krumholz & Mentlik

[57] ABSTRACT

A pinning system for use with prefabricated barriers and a method of assembling prefabricated barriers is disclosed. The pinning system permits custom-sized, prefabricated barriers to be arranged between adjacent barrier sections so that a continuous barrier can be obtained. The pinning system includes slideable elongate pins which are adapted to be selectively moved between a non-extended position at which elongate pins are located at least substantially within a passageway, and an extended position at which a portion of the elongate pins protrudes outside of the passageway beyond the exterior surface of the barrier section from which it is initially arranged.

33 Claims, 4 Drawing Sheets

PINNING SYSTEM FOR PREFABRICATED BARRIERS

FIELD OF THE INVENTION

The present invention relates to a pinning system for interconnecting prefabricated barriers. More particularly, the present invention relates to a pinning system having slideably moveable pins for use with jersey barriers.

BACKGROUND OF THE INVENTION

Automobile accidents account for thousands of untimely deaths in the United States every year. In an effort to curtail the number of deaths caused by automobile accidents, inventors have exerted great effort to develop various devices for minimizing the risk of death or serious injury which may occur during an automobile crash on highways and bridges.

Safety concerns have also prompted automobile manufacturers to exert large amounts of time and money to minimize the risk of injury to the occupants of automobiles. In this regard, automobile manufacturers have installed air bags and anti-lock brakes as optional or standard features in many types of vehicles. These types of safety features are particularly expensive because of the high costs of research and design and the continued expense associated with incorporating such safety features in each and every vehicle sold.

State governmental agencies, such as the Department of Transportation, have been established by each state to promulgate rules and regulations and to oversee new construction and work done on existing highways and bridges to assure that same are sufficiently safe for use by the public. One particularly preferred and approved means used to increase the safety of highways and bridges include the use of "jersey barriers". These barriers have proven to be effective at reducing the number of head-on crashes and other serious automobile accidents. The use of jersey barriers are also know to be effective at minimizing injury to occupants of an automobile and reducing damage to the automobile if it should happen to veer off of the roadway into such barriers.

The structural specifications of jersey barriers including the manner in which they are interconnected is also governed by the Department of Transportation in each state that requires the use of jersey barriers. In this regard, the Department of Transportation has an interest in assuring that the various components of a jersey barrier system are properly secured together.

A jersey barrier wall system generally includes a plurality of similarly sized jersey barriers, each having a first end including female receptacles and a second end including a plurality of fixed pins extending therefrom. The fixed pins are arranged in alignment with corresponding female receptacles of an adjacent jersey barrier when the individual components are placed in assembled position to obtain an end-to-end configuration. The individual jersey barrier components are thus secured against movement in a lateral direction relative to each other. When jersey barriers are used to partition adjacent lanes of a highway from each other, it is required to provide a certain number of specially sized jersey barrier components to customize the particular barrier system to fill gaps in the barrier wall caused by the specific placement of barrier components over obstacles such as catch basins, and the like. The specially sized components are known as closure pieces.

Catch basins are necessary to permit water to run off certain highways during storms without accumulating thereon and causing hazardous or impossible driving conditions. It is therefore important to prevent catch basins from becoming clogged due to debris, which may be washed off of a highway during a storm. In order to address this potential problem, specially cast jersey barrier components, including a "throat" section adjacent the center of the bottom of the barrier components, are utilized. The throat section is simply a cut out section which will permit water and relatively small objects to pass therethrough. Thus, when a throat section of a jersey barrier component is placed adjacent a catch basin, water is permitted to freely drain into the catch basin. In order to assure proper placement and alignment of the throat section over the corresponding catch basin, it is usually required to place the jersey barrier component including such throat section in its intended position over the catch basin prior to placement of other jersey barrier components into assembled position. In most circumstances, the jersey barrier components which have throat sections therein are of a "standard" size, i.e., similar in size to the other barrier components of the jersey barrier system.

Although the distance between catch basins on a highway may vary, many highways include catch basins spaced at predetermined intervals such as approximately 250 feet. When jersey barrier systems are assembled in accordance with the method discussed above, a gap having a length less than the length of the standard sized barrier components is often left in the barrier wall at some location within the area extending between the spaced catch basins. For instance, after placing a series of twenty foot jersey barriers to fill the area between the spaced catch basins, eventually a gap smaller than twenty feet will exist. Since this gap is too small to accommodate a standard sized twenty foot jersey barrier component, it is necessary to measure the specific distance of the gap and to custom cast a closure piece to fill the gap so that the jersey barrier system is continuous.

The Department of Transportation in all or most states require that the jersey barrier system be continuous as the exposure of blunt ends is dangerous and may result in serious injury or an accident if an automobile should crash into same. Thus, it is important to fill the gaps with closure pieces to assure that the jersey barrier system is continuous and that no blunt ends of the individual jersey barrier components are exposed along the highway to be partitioned.

Accordingly, after taking measurements of those areas which require specially sized and/or shaped jersey barriers (i.e., closure pieces), the closure pieces are cast according to the customized specifications. Since the jersey barrier wall system must be continuous, the length of each of the closure pieces must closely correspond to the length of the open space that needs to be blocked off. Thus, the usual manner of interconnecting aligned fixed pins with female receptacles of adjacent jersey barriers cannot be used for closure pieces which need to be placed between two existing jersey barriers in a closely sized relationship with respect to the open gap.

In the past, attempts to overcome the problem of securing closure pieces to adjacent sections of the jersey barrier wall system were made by cutting off the fixed pins from one of the adjacent jersey barrier sections and thereafter sliding the closure piece into its proper position. Extensive drilling through the solid concrete components of the jersey barrier system was then required. Steel plates were then used to secure the closure piece to adjacent jersey barriers by placing bolts through apertures in steel plates and the aligned holes that were drilled to extend through the jersey barriers. This process of connecting closure pieces to adjacent jersey barriers was and is quite time consuming and expensive.

The present invention overcomes the aforementioned shortcomings by providing a pinning system for use with prefabricated barriers, such as jersey barriers, wherein the pinning system includes plurality of slideably moveable elongate pins which can be selectively moved into aligned female receptacles to obtain lateral securement of closure pieces with respect to adjacent sections of a prefabricated barrier.

SUMMARY AND OBJECTS OF THE INVENTION

One aspect of the present invention pertains to a pinning system for use with prefabricated barriers. In a preferred embodiment, the pinning system includes barrier means for forming a barrier which may be used to partition off adjacent areas. The barrier means includes an exterior surface which defines an interior area and at least one passageway extending from the interior area to the .exterior surface. The pinning system also includes at least one pin assembly which includes at least one elongate pin having a predetermined length. The at least one elongate pin is slideably arranged within the at least one passageway for selective movement between a non-extended position, at which the at least one elongate pin is located at least substantially within the at least one passageway, and an extended position at which a portion of the at least one elongate pin protrudes from the at least one passageway beyond the exterior surface whereby the at least one pin can be concurrently arranged within at least one aligned passageway of adjacent barrier means so that corresponding portions of the predetermined length of the at least one elongate pin partially extends within the at least one passageway of the barrier means and within the at least one aligned passageway of the adjacent barrier means.

The barrier means may comprise a jersey barrier having first and second ends adapted to be connected to adjacent jersey barriers. In this preferred embodiment, the at least one passageway extends within the jersey barrier from the interior area thereof to at least one of the first and second ends.

Preferably, the at least one passageway comprises a plurality of passageways and the at least one pin assembly comprises a plurality of pin assemblies which include a plurality of elongate pins arranged in corresponding ones of the plurality of passageways.

It is preferable for the plurality of pin assemblies to comprise a plurality of conduits arranged within corresponding passageways. In this preferred embodiment, corresponding ones of the plurality of elongate pins are arranged within the plurality of conduits for selective slideable movement from a nonextended position to an extended position.

The plurality of passageways of the pinning system may include a first section which extends between the exterior surface of a first end of an associated jersey barrier and a location within the interior area thereof. The first section of each of the passageways has an exterior end which defines an aperture at the exterior surface of the first end of the associated jersey barrier and an interior end which defines an opening at a selected location within the interior area. Each of the plurality passageways may also include a second section which has an interior end connected to the interior end of the first section at the preselected location within the interior area of the jersey barrier. The second section is preferably arranged at an acute angle with respect to the first section and permits open communication between the first and second sections. The second section may also have an exterior end defining an aperture at a preselected location on the external surface of the jersey barrier. The preselected external location may be arranged within a plane extending generally perpendicular to a plane which extends along the exterior surface of the first end of the jersey barrier. For instance, the aperture at the preselected location may be arranged at the rear surface or the top surface of the associated jersey barrier. In this preferred embodiment, each of the plurality of elongate pins are arranged within corresponding first sections of the plurality of passageways for slideable movement from a nonextended to an extended position. An elongate tool, such as a plumber's snake, may be used to push corresponding ones of the elongate pins from their nonextended position to their extended position.

Preferably, the aforementioned pining system comprises a first conduit arranged within each of the first sections and a second conduit arranged within each of the second sections. In this preferred embodiment, the plurality of elongate pins are arranged within corresponding ones of the first conduit for selective slideable movement from their nonextended position to their extended position. The conduit may be made of various materials. However, in a preferred embodiment, the first and second conduits comprise PVC tubing. Similarly, although the material of which the jersey barriers are made vary, in a preferred embodiment the jersey barrier is made of concrete and the PVC tubing is cast within the concrete.

In another preferred embodiment, the plurality of pin assemblies further comprise connecting means arranged between the first and second conduits for connecting the first and second conduits at an acute angle with respect to each other. The connecting means may comprise an additional conduit and may also include PVC tubing.

The pinning system of the present invention may also comprise means for detecting whether one or more of the elongate pins are in their extended or nonextended positions. Such means may consist of utilizing different colors at preselected locations on the elongate pins and viewing means to detect whether the elongate pins are arranged in proper position.

In another preferred embodiment, the pinning system may comprise restraining means for selectively retaining the elongate pins in their nonextended position. It is also preferable for the pinning system to comprise movement means for selectively sliding the elongate pins from their nonextended position to their extended position. The movement means may be adapted to automatically or manually force the elongate pins to slide from their nonextended position to their extended position.

In another preferred embodiment, one or more of the elongate passageways may have an exterior end defining an aperture at the exterior surface of the barrier means and an interior end defining an abutment at a preselected location within the interior area thereof. In this embodiment, movement means are preferably utilized and may include spring means arranged between the abutment and trailing end of a corresponding one of the elongate pins for continuously biasing the elongate pin from its nonextended position to its extended position.

It is desirable for the barrier means to include a closure piece having a first end which is adapted to be connected to a first adjacent jersey barrier and a second end which is adapted to be connected to a second adjacent jersey barrier. The closure piece may comprise a custom sized jersey barrier and preferably includes an exterior surface defining an interior area and a plurality of passageways extending from the interior area to the exterior surface at the first and second ends of the closure piece. Each of the plurality of passageways include at least one external end defining an aperture at the exterior surface of the closure piece. A plurality of pin assemblies including a plurality of elongate pins having a predetermined length are slideably arranged within corresponding ones of the plurality of passageways for selective movement between a nonextended position, at which the elongate pins are located at least substantially within corresponding ones of the plurality of passageways, and an extended position, at which a greater portion of the plurality of elongate pins protrude from the corresponding passageways beyond the exterior surface. The first and second adjacent barriers have female receptacles aligned with the plurality of elongate pins and are adapted to receive such elongate pins therein when the elongate pins are arranged in their extended position so that the elongate pins are concurrently disposed in the passageways of the closure piece and the female receptacles of the first and second adjacent jersey barriers.

Another aspect of the present invention pertains to a method of assembling prefabricated barriers, such as jersey barriers, wherein the method comprises the steps of providing a plurality of at least similarly sized barriers having first and second ends and female receptacles arranged at the first and second ends. At least one of the identically sized barriers are then placed at a preselected location to form a first barrier section. One or more of the similarly sized barrier are then arranged at a predetermined spaced distance from the first barrier section to form a second barrier section so that a predetermined space is left between the first and second barrier sections. The predetermined space is smaller than the length of one of the similarly sized barrier. A closure piece is then provided wherein the closure piece has a length substantially equivalent to the length of the predetermined space. The closure piece includes passageways having apertures disposed at both ends thereof and elongate pins slideably arranged within corresponding passageways. The closure piece is then arranged within the predetermined space so that the first and second barrier sections appear as one continuous barrier section. The passageways on the ends of the closure piece are then aligned with female receptacles on the first and second ends of the first and second barrier sections. The method further comprises the step of sliding at least a portion of the elongate pins from the passageways within the closure piece until the elongate pins extend into the aligned female receptacles so that the closure piece is secured against lateral movement with respect to the first and second barrier sections.

Preferably, the elongate pins used in connection with the aforementioned method are concurrently disposed in the passageways of the closure piece and the female receptacles of the first and second adjacent barrier sections.

The step of sliding the elongate pins from the passageways of the closure piece into the aligned female receptacles of the first and second adjacent barrier sections preferably includes the step of pushing the elongate pins into the female receptacles. When performing this step of the present method, the elongate pins may be manually pushed from their position within the passageways by using a plumber's snake, or other elongate tool. Additionally, the elongate pins may be pushed by compressed air or other pneumatic, hydraulic or mechanical means. In another embodiment, the step of sliding the elongate pins may be performed automatically by removing a restraining device from the apertures of the passageways so that corresponding spring means can bias the elongate pins to slide into the female receptacles of the adjacent first and second barrier sections.

In a preferred embodiment, the method comprises the step of flowing filler material into a portion of the passageways after the elongate pins have been at least partially moved out of the passageways and into the aligned female receptacles. The filler material is then permitted to harden so that the corresponding pins will be secured in assembled position within the female receptacles. In a preferred embodiment, the filler material may comprise grout. However, the filler material may also comprise other types of mortar and the like.

In a preferred embodiment, at least one of the similarly sized barriers has a centrally arranged throat portion adjacent the bottom of the barrier. In this preferred embodiment, the step of arranging at least one of the similarly sized barriers in a preselected location comprises the step of placing the throat portion of the barrier over a catch basin so that the throat portion is adjacent the catch basin.

Accordingly, it is an object of the present invention to provide a new and improved pinning system for use with prefabricated barriers, such as jersey barriers, wherein time and money will be saved by using such pinning system.

It is another object of the present invention to provide a pinning system for use with barriers, such as jersey barriers, that will securely fix a closure piece between adjacent jersey barrier components against movement in a lateral direction.

The above summary, as well as further objections, features and advantages of the present invention will be more fully understood with reference to the following detailed description of the pinning system, particularly when taken in conjunction with the accompanying drawings and the following brief description thereof.

DETAILED DESCRIPTION OF THE PREFERRED EMBODIMENTS

In accordance with one embodiment of the present invention, a pinning system is used to connect components of a prefabricated barrier system. In the preferred embodiment shown in FIGS. 1–5, the prefabricated barrier components comprise jersey barriers including a first barrier section generally designated 10, a second barrier section generally designated 42 and a closure piece generally designated 64. It should be appreciated, however, that the pinning system of the present invention may be used with other types of prefabricated barriers other than jersey barriers.

The term "jersey barriers" designate a well known type of barrier that was first developed for use on highways in New Jersey. Jersey barriers have been proven to be a particularly effective way at reducing serious injury and fatalities in accidents which occur on highways throughout the United States. Accordingly, the Department of Transportation of many different states now require contractors to use jersey barriers to partition adjacent lanes from each other when building or repairing highways.

Figure 1:
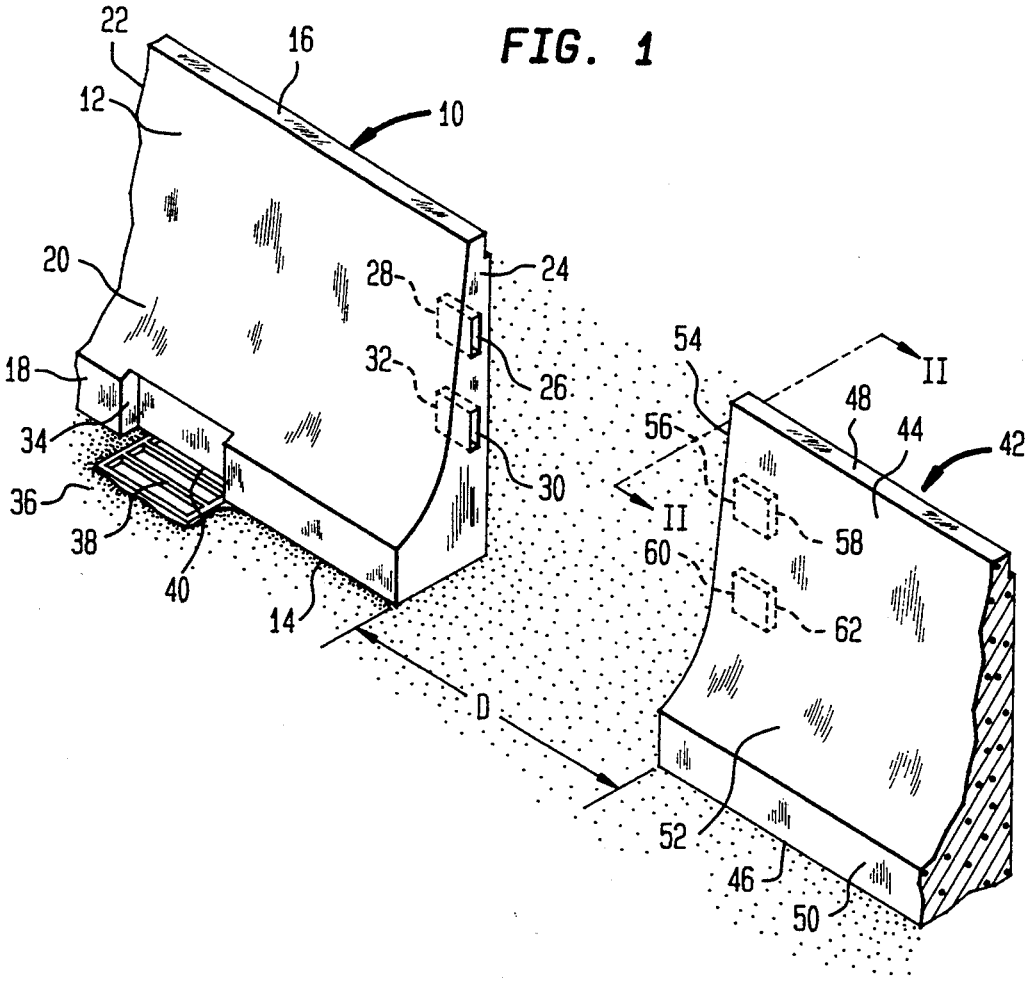
FIG. 1 is a perspective view of selected components of a jersey barrier system to be used with the present invention.

As shown in FIG. 1, the first barrier section 10 comprises an isolated jersey barrier component. However, it should be appreciated that as used in the present application, the term "first barrier section" may also comprise a plurality of jersey barrier components interconnected to each other in an end-to-end relationship.

Figure 3:
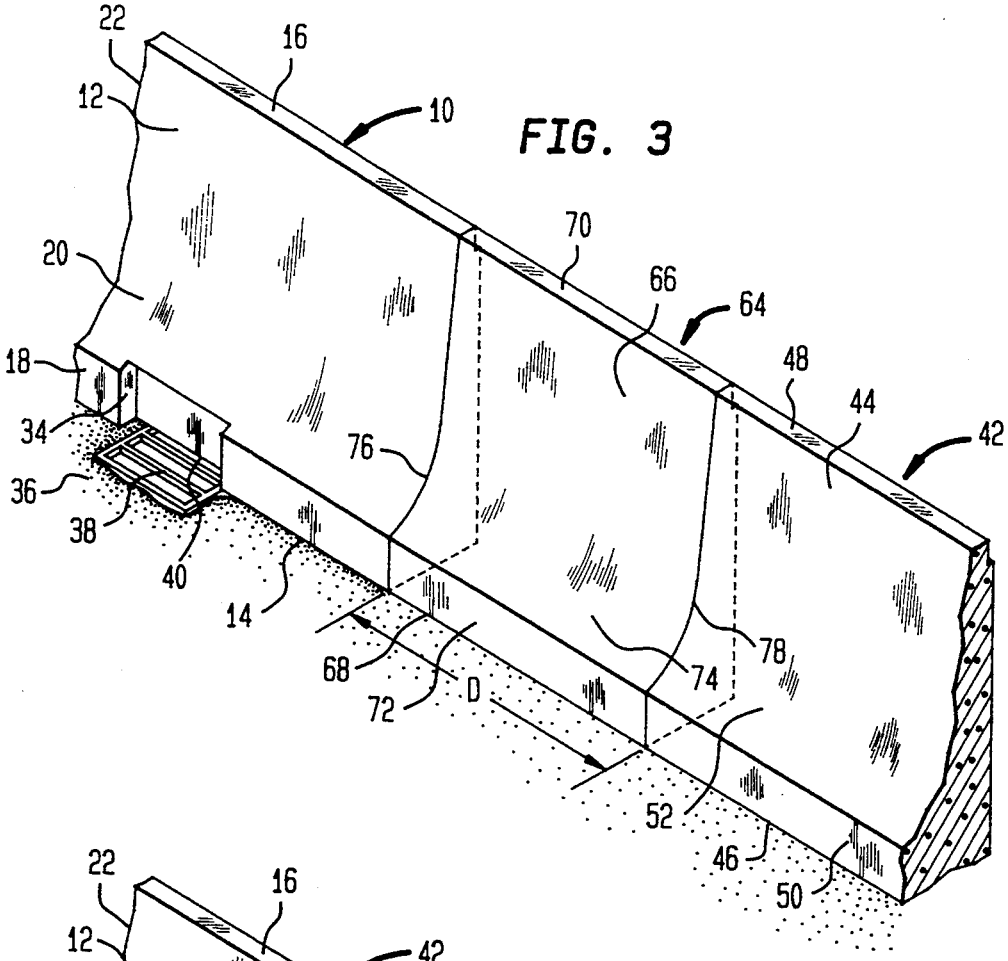
FIG. 3 is a perspective view of a continuous jersey barrier system with the closure piece of the present invention arranged between adjacent components of the barrier system.

As best shown in FIGS. 1 and 3, the first barrier section 10 includes a front surface 12 and bottom surface 14 resting on a road 36. A top surface 16 is spaced from the bottom surface 14 and includes a smaller surface area due to the generally tapered configuration of associated jersey barrier. A relatively wide base section 18 is arranged adjacent the bottom surface 14. The first barrier section 10 also includes a sloping transition section 20 arranged between the base section 18 and the top surface 16.

As illustrated in FIG. 1, the first barrier section 10 includes a single jersey barrier component having a left end 22 and a right end 24 each of which defines an external surface area. For reasons discussed in detail below, it is preferable for each of the ends to define apertures for one or more female receptacles which extend into the interior area of the barrier body. The apertures of the female receptacles arranged on the surface of left end 22 are not shown in the drawings. However, these apertures are preferably identical to the apertures of female receptacles 26 and 30 arranged on the external surface of right end 24.

The top female receptacle 26, which defines an aperture arranged in the surface of right end 24, includes a passageway ending with an abutment 28 within the interior area of the first barrier section 10. The bottom female receptacle 30 also includes an aperture arranged on the external surface of right end 24 and includes a passageway terminating with abutment 32 also arranged within the interior area of the first barrier section 10. Although the specific dimensions of female receptacles 26 and 30 may vary, in one preferred embodiment, each of these receptacles has a height of approximately 6 inches extending along an axis between the bottom surface 14 and the top surface 16 of the first barrier section 10. The width of the female receptacles 26 and 30 my be approximately 1½ inches, and the passageways extending between the apertures on the surface of right end 24 and the interior abutments 28 and 32 may be about nine inches long. As can be appreciated, all of the dimensions of the female receptacles 26 and 30, including the depth of the passageways extending from the interior area to the external surface of the first barrier section 10 may vary in alternate embodiments while still remaining within the scope of the present invention.

Most of the individual barrier components of a jersey barrier system, except for a select number of custom sized closure pieces, are usually about the same length. In this regard, barrier components, such as the component comprising first barrier section 10 may be about twenty feet long. Of course, the length of the barrier components may vary depending on the particular specifications of a job. However, for ease of reference in this application, twenty feet will be considered a standard length. Although other dimensions of the barrier components may also vary from job to job, in one preferred embodiments the base section 18 may be approximately 16 inches wide, while the width adjacent the top surface 16 may be only about 6 inches wide. The height of a barrier component may be fifty four inches between the bottom surface 14 and the top surface 16.

Typically, jersey barriers are made out of concrete and are cast in an off-site location. The cast jersey barriers are then transported to a particular job site where they are assembled in an end-to-end relationship in a desired location. On highway jobs, where drainage problems must be considered, catch basins are often spaced at predetermined intervals from each other. The predetermined intervals may vary in different areas. However, for the purpose of this application, it will be assumed that catch basins along a particular highway job are spaced at about 250 foot intervals from each other. The dimensions of catch basins also vary from area to area. However, for the purpose of this application, it will be assumed that catch basins are about five feet long (i.e., extending along the direction of travel of an adjacent highway) and 13 feet wide (i.e., traversing the direction of traffic on highways which have catch basins present between adjacent lanes).

A throat section 34 is cut into the first barrier section 10. As illustrated in FIGS. 1 and 3, the throat section 34 is arranged adjacent the bottom surface 14 and extends into the base section 18 of the first barrier section 10. When arranged in proper position, the throat section 34 of the first barrier section 10 is preferably adjacent a catch basin, such as catch basin 38 as shown in FIG. 1.

In this arrangement, a clearance 40 exists between the catch basin 38 and the bottom of the throat section 34.

FIGS. 1–4 illustrate a second barrier section 42 which comprises a plurality of individual jersey barrier components. The general configuration of the second barrier section is the same as the configuration of the first barrier section 10. Thus, the second barrier section 42 comprises a front surface 44, a bottom surface 46, and a top surface 48. A relatively wide base section 50 is arranged adjacent the bottom surface 46 and extends upwardly therefrom. As with the first barrier section 10, the second barrier section 42 also includes a sloping transition section 52 arranged between the base section 50 and the top surface 48.

Although the second barrier section 42 may have a right end at some point thereon, for the purpose of this application it will be assumed that the second barrier section 42 is substantially continuous. The surface of the left end 54 can best be appreciated from the illustration in FIGS. 1 and 2 and is substantially a mirror image of the surface of the right end 24 of the first barrier section 10.

A plurality of female receptacles including a top receptacle 56 and the bottom receptacle 60 are arranged to extend from the interior area of the second barrier section 42 to the exterior surface of left end 54. These female receptacles are placed in the same relative position as the female receptacles 26 and 30 arranged on the right end 24 of first barrier section 10. Thus, female receptacle 56 has an aperture arranged on the surface of the right end 54 and a passageway ending with abutment 58 at the interior area of the second barrier section 42. Similarly, receptacle 60 includes an aperture arranged on the surface of the left end 54 and a passageway ending with abutment 62 arranged at the interior area of the second barrier section 42.

A distance designated by reference letter D is shown in FIG. 1 between the right end 24 of first barrier section 10, and the left end 54 of second barrier section 42. As discussed above, for the purpose of this application, a standard size for the individual jersey barrier components is approximately twenty feet. Thus, the distance D represents some distance less than twenty feet in length. When the jersey barrier wall system is completed, it will appear as a continuous jersey barrier and thus, the open space designated by distance D will be filled in by closure piece 64. This common aspect of jersey barrier systems is discussed further below.

Figure 2:
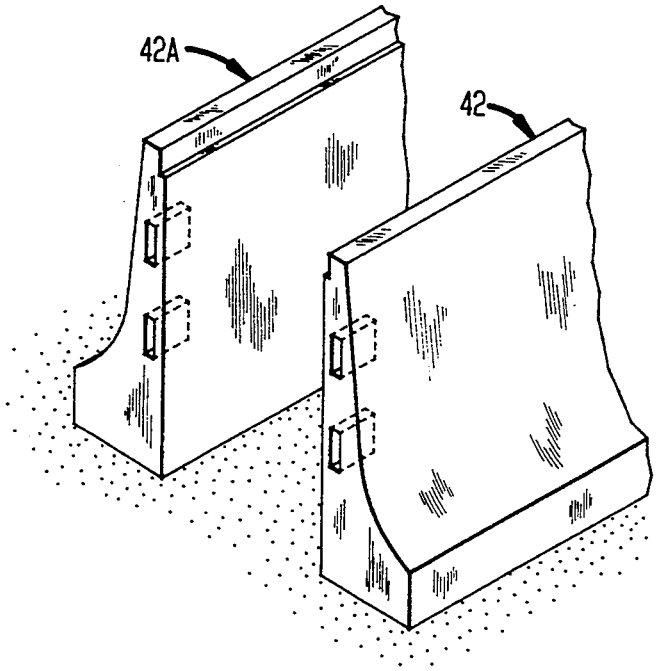
FIG. 2 is a side view of a pair of jersey barrier sections of a jersey barrier system taken along line II—II of FIG. 1 with an additional barrier section shown in parallel relation to the barrier section shown in FIG. 1.

In some applications, it is desirable to use two lines of continuous jersey barriers to separate adjacent highways or highways in which vehicles travel in opposite directions. Such an embodiment is shown in FIG. 2, wherein a pair of second sections 42 and 42A are clearly shown extending parallel to each other. In this embodiment, the additional continuous second barrier section 42A includes all of the same components and is identical to the first line of the second barrier section 42.

In order to assure that the throat sections of jersey barriers are properly aligned adjacent to respective catch basins, it is the usual practice to place precast jersey barriers having centrally arranged throat sections thereon in position over a catch basin before additional components of the jersey barrier system are assembled into place. After this has occurred, additional jersey barrier components are usually placed in an end-to-end relationship with adjacent jersey barrier components to form a continuous wall. Each of the standard cast jersey barrier components usually includes a pair of fixed pins extending from either the right or left end and a pair of female receptacles defining apertures arranged on the other end. The pins and receptacles are lined up with each other so that individual jersey barrier components can be interconnected in a continuous line by arranging the fixed pins of one end of the jersey barrier component into corresponding female receptacles of an adjacent jersey barrier component.

As discussed above, catch basins may be arranged at 250 foot intervals. Since it is important to align the throat section, such as throat section 34 of first barrier section 10 with an associated catch basin, such as catch basin 38, the jersey barrier components having throat sections therein are generally placed into assembled position over corresponding catch basins before additional standard sized jersey barriers are interconnected to form a first barrier section and a second barrier section. After the throated jersey barrier components are placed in assembled position and the additional standard sized twenty foot jersey barrier components are connected by placing corresponding fixed pins into female receptacles of adjacent jersey barrier components, a gap will usually remain somewhere between each of the spaced catch basins. As indicated above, this gap is represented in FIG. 1, by reference letter D.

The distance D will usually change each time that a first barrier section and a second barrier section is placed in correspondence with each other. This is so because catch basins are not always spaced at exactly the same 250 foot distance from each other.

It is important for the jersey barrier system to remain continuous so that no blunt edges, such as right end 24 of first barrier section 10 or left end 54 of second barrier section 42, will be exposed along the highway. In order to fill the gap D between the first barrier section 10 and the second barrier section 42, it is required to first measure the distance D. A custom sized barrier component is then manufactured in accordance with the length required to substantially fill the distance D between the first barrier section 10 and the second barrier section 42. This custom sized barrier component is called a closure piece and is designated in FIGS. 3–5 by reference numeral 64.

Except for the length, the external configuration of closure piece 64 is substantially similar to the configuration of first barrier section 10 and second barrier section 42. In this regard, closure piece 64 includes a front surface 66 and a bottom surface 68. The bottom surface 68 is adapted to be placed in correspondence with the road surface 36. A top surface 70 is spaced from the bottom surface 68 and has a substantially narrower width due to the tapered configuration of jersey barriers. A relatively wide base section 72 is arranged adjacent the bottom section 68. The closure piece 64 also includes a left end 76 defining an external surface thereon and a right end 78 also defining an external surface.

Figure 4:
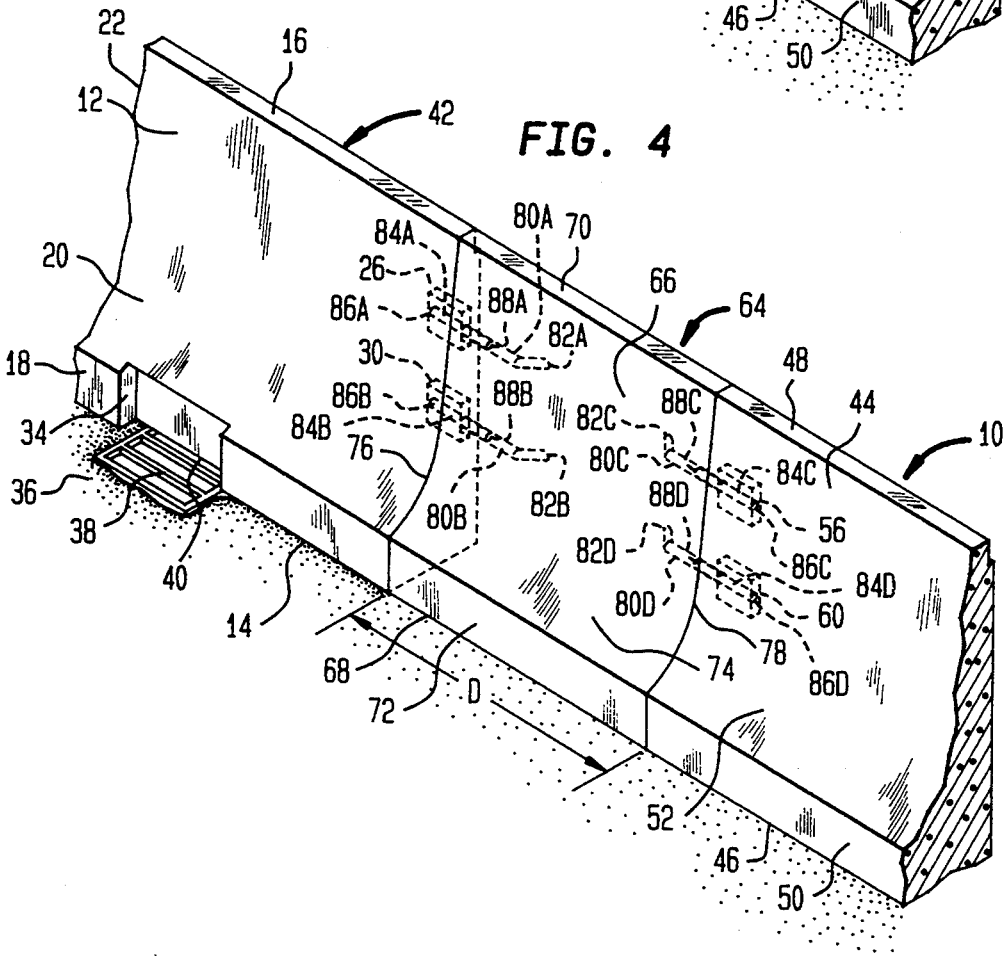
FIG. 4 is a front partially transparent view of a portion of the jersey barrier system shown in FIG. 3, illustrating the pinning system of the present invention in assembled position operatively associated with a closure piece and adjacent barrier sections.

As illustrate in FIGS. 3 and 4, the left end 76 of the closure piece 64 is adapted to be placed adjacent right end 24 of first barrier section 10 when in assembled position. Similarly, right end 78 of closure piece 64 is adapted to be placed adjacent left end 54 of second barrier section 42. Thus, the jersey barrier system appears as a continuous barrier when closure piece 64 is placed in its proper assembled position adjacent first barrier section 10 and second barrier section 42.

As discussed above, the standard twenty foot barrier sections are typically cast with a pair of fixed elongate pins extending from one end thereof and a pair of aligned female receptacles defining apertures arranged in the opposing end. This structure facilitates the end-to-end assembled relationship of individual jersey barrier components which thus form a continuous jersey barrier system that is substantially fixed against movement in a lateral direction. However, since the overall length of the closure piece 64 substantially corresponds with distance D between first barrier section 10 and second barrier section 42, it is not practical to have fixed pins extending from either the right end 24 of first barrier section 10 or the left end 54 of second barrier section 42. Instead, these ends of the first and second barrier sections should be equipped with apertures of female receptacles which are adapted to receive slideable pins initially retained within the interior are of closure piece 64. This is an important feature of the present invention and will be discussed in detailed below.

The closure piece 64 is illustrated in FIG. 4 as comprising four pin assemblies including passageways 80A–D and 82A–D having four corresponding slideable elongate pins 84A–D therein. It should be appreciated that closure piece 64 may include more or less than four pin assemblies depending on requirements of the Department of Transportation for a particular state or contractor's specifications.

Figure 5:
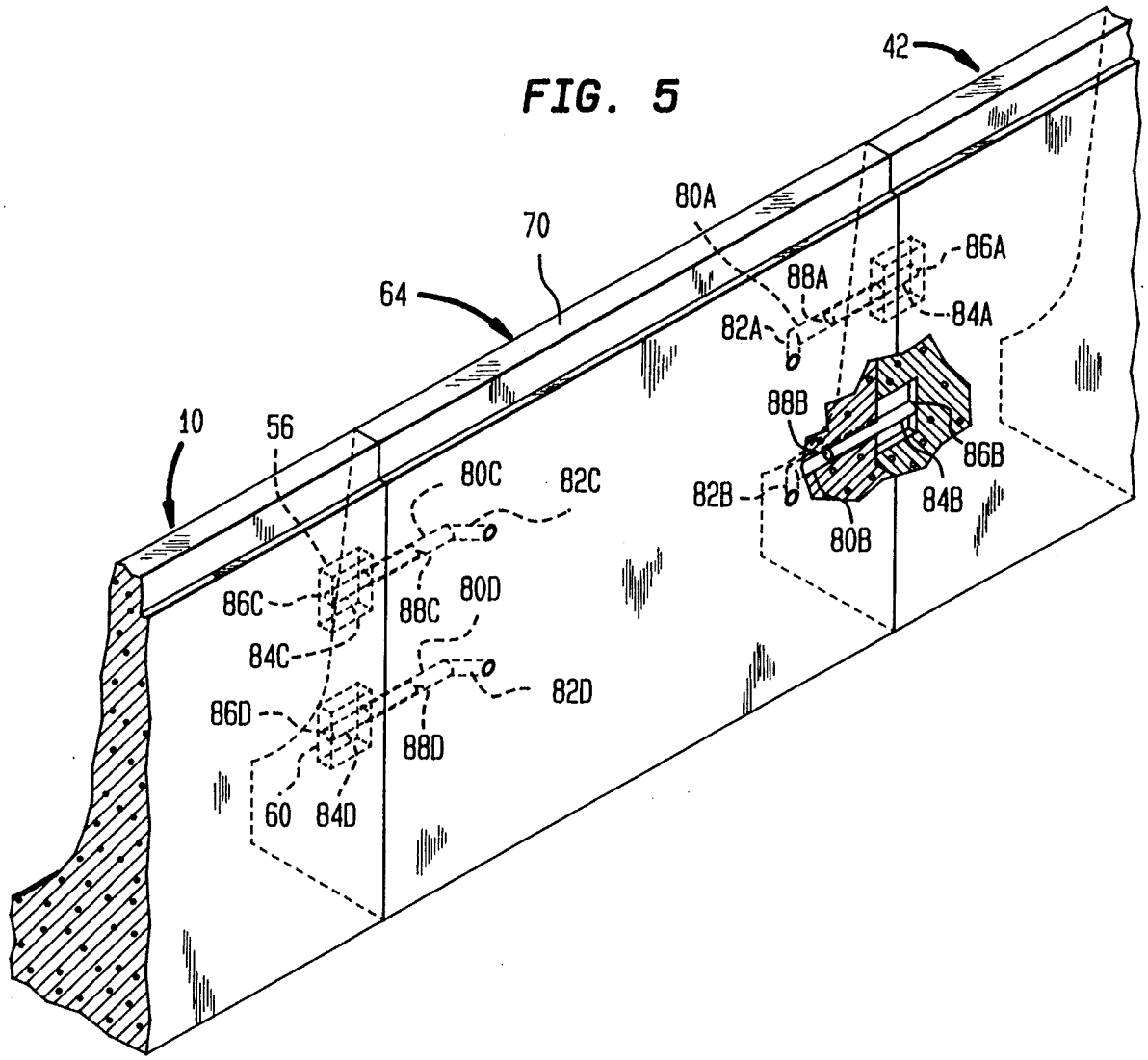
FIG. 5 is a rear partially transparent view of the portion of the jersey barrier system shown in FIG. 4.
Figure 6:
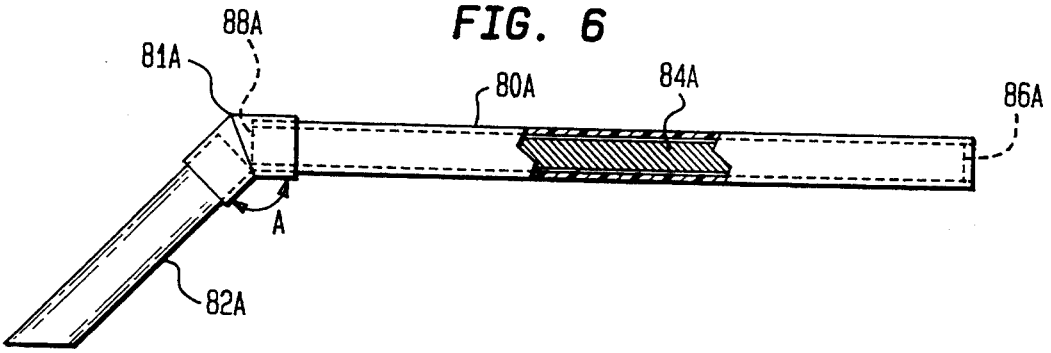
FIG. 6 is a front view of a portion of one embodiment of a pinning system in accordance with the present invention, with the associated elongate pin shown in phantom in its nonextended position.

In the embodiment shown in FIGS. 4–6, the slideable pin assemblies include a first elongate passageway 80A–D having an aperture arranged adjacent the external surface at left end 76 of closure piece 64. Each of the passageways extend into an interior area within the closure assembly 64. Corresponding second elongate passageways 82A–D are connected to the first passageways at the interior area of the closure piece 64. The second passageways 82A–D extend from the interior area to the external surface of the closure piece 64 by defining an aperture at the rear surface 90 thereof. This feature of the present invention is best shown in FIG. 5.

Each of the first passageways 80A–D and the corresponding second passageways 82A–D connected thereto are shown in FIGS. 4–6 as comprising conduits cast into a solid concrete closure piece 64. The conduits 80A–D and 82A–D may comprise PVC tubing. However, it should be appreciated that the passageways need not be made of PVC tubing; or consist of any other conduit material, as the passageways may be formed by drilling through the closure piece 64 or by being molded therein during casting operations.

Passageways 80A–D are preferably about eighteen inches long and have a diameter slightly greater than one inch. Each of the passageways 80A–D are adapted to retain an elongate pin 84A–D therein. The elongate pins of the present invention may comprise various acceptable rigid materials and sizes. In one preferred embodiment, the elongate pins 84A–D comprise a galvanized steel ASTM A36 dowel. Elongate pins 84A–D are also approximately eighteen inches long and are adapted to be entirely disposed within corresponding ones of the passageways 80A–D when the elongate pins 84A–D are in their non-extended position. In other embodiments, the elongate pins 84A–D may initially be arranged with a portion of the length thereof extending out of their corresponding passageways 80A–D.

Each of the elongate pins 84A–D have a trailing end 80A–D and a leading end 86A–D. The leading end 86A–D is preferably arranged within corresponding apertures of passageways 80A–D slightly below the surfaces at left end 76 and right end 78 of closure piece 74 when the elongate pins 84A–D are in their non-extended position.

As best shown in FIG. 6, passageways 82A–D are connected to corresponding passageways 80A–D to form an acute angle A therebetween. The means of connecting passageways 82A–D to corresponding passageways 80A–D may be by use of a connector joint 81, which may be a 45' sweep PVC joint. In one preferred embodiment, passageways 82A–D may comprise PVC tubing having a diameter of approximately one inch and a length of approximately five inches, and may extend between the external surface 90 of closure piece 64 when arranged in its assembled position adjacent passageways 80A–D at an interior area within closure piece 64.

It is important for the apertures of passageways 80A–D to line up with corresponding female receptacles of adjacent barrier sections so that closure piece 64 can be properly interconnected to first barrier section 10 and second barrier section 42.

In particular, passageway 80A should be aligned with top female receptacle 26 at the surface of right end 24 of the first barrier section. Similarly, passageway 80B should be aligned with the bottom female receptacle 30 at the surface of right end 24 of first barrier section 10. Further, passageway 80C should be aligned with top female receptacle 58 at the surface of left end 54 of second barrier section 42, and passageway 80D should be aligned with bottom female receptacle 60 which exits the surface of left end 54 of second barrier section 42.

When closure piece 64 is placed in its proper aligned position adjacent first barrier section 10 and second barrier section 42, the slideable elongate pins 84A–84D may be moved from their non-extended position within the corresponding passageways 80A–D to their extended position, at which they extend out of the apertures of the passageways at left end 76 and right end 78 of closure piece 64. In one embodiment, approximately nine inches of the elongate pins 84A–D extend beyond the external surface of closure piece 64 when they are in their extended position.

As elongate pins 84A–D slideably move from their non-extended to their extended position, they enter into corresponding female passageways 26, 30, 56, and 60. When elongate pins 84A–D are arranged in their outermost extended position, the leading ends 86A–D should bottom out at corresponding abutments 28, 32, 58, and 62, respectively. When this situation arises for the preferred embodiment discussed above, approximately nine inches of the length of elongate pins 84A–D will remain within corresponding passageways 80A–D, and approximately nine inches of the length of elongate pins will extend into corresponding female receptacles, 26, 30, 56, and 60.

Movement of the elongate pins 84A–D from their non-extended position to their extended position can be accomplished by using a plumber's snake, or other elongate flexible tool, by inserting such plumber's snake through corresponding passageways 82A–D. As illustrated in FIG. 5, passageways 82A–D define corresponding apertures at the rear surface 90 of closure piece 64. Thus, as a plumber's snake is extended through the length of the passageways 82A–D, its flexible nature will permit it to bend as it passes through the 45' sweep PVC joint 81A–D. Eventually, the plumber's snake will come in contact with trailing end 88A–D of corresponding elongate pins 84A–D, respectively. As the plumber's snake is continuously extended through passageways 82A–D, after it comes in contact with trailing end 88A–D of elongate pins 84A–D, the corresponding leading end 86A–D emerges out of the respective passageways 80A–D and enters corresponding female receptacles as described above.

Of course, other flexible tools besides a plumber's snake could be utilized to cause the slideable elongate pins 84A–D to move from the non-extended position to the extended position. Additionally, in other embodiments, passageways 82A–D may be angled to exit different surface of the closure piece 64 other than the rear surface 90. For example, passageways 82A–D may exit the top surface 70, or the front surface 66 of the closure piece 64. The important feature of this aspect of the invention is that the elongate pins 84A–D are accessible to obtain slideable movement from their non-extended position to their extended position.

Figure 7:
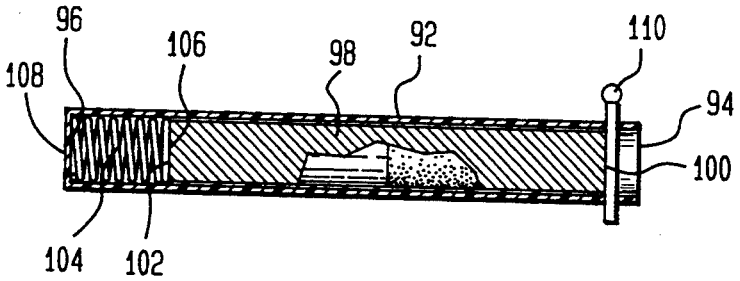
FIG. 7 is a second embodiment of a portion of the pinning system in accordance with the present invention with the elongate pin shown in phantom in its nonextended position.
Figure 8:
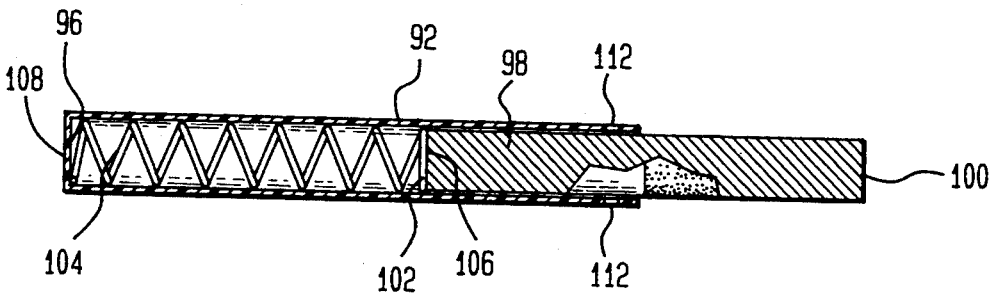
FIG. 8 is a front view a portion of the pinning system shown in FIG. 7 with the associated elongate pin shown in its extended position.

A second embodiment of a pin assembly in accordance with the present invention is shown in FIGS. 7 and 8. In this embodiment, slideable movement of associated elongate pins may be obtained automatically by the use of a spring. Although this embodiment of the present invention will now be discussed with reference to a single pin assembly, it should be understood that in a preferred embodiment, a plurality of the pin assemblies shown in FIGS. 7 and 8 will be incorporated into a closure piece, such as closure piece 64.

In accordance with the second embodiment of the present invention, the pin assembly includes a conduit 92 which may comprise PVC tubing, tubing made of a different material, or a pre-drilled or cast molded hole within the closure piece. For the purpose of describing the second embodiment, it will be assumed that the conduit 92 includes PVC tubing which is sized to permit an elongate pin 98 to be entirely retained therein when the elongate pin 98 is in its non-extended position.

As with the embodiment shown in FIG. 6, the elongate pin may comprise a galvanized steel ASTM A36 dowel having a length of approximately eighteen inches and a diameter of approximately one inch. As illustrated in FIG. 7, the PVC tubing 92 includes a first end 94 which defines an aperture and a second end 96 which defines an abutment. The elongate pin 98 includes a leading end 100 and a trailing end 102 which is adapted to be retained at all times within PVC tubing 92.

A spring 104 is arranged within PVC tubing 92 to cause the elongate pin 98 to move from its non-extended to its extended position. The spring 104 includes a first end 106 arranged in assembled position adjacent the trailing end 102 of the elongate pin 98. The spring 104 also includes a second end 108 arranged adjacent abutment 96.

When the elongate pin 98 is arranged in its non-extended position, the spring 104 is compressed between the trailing end 102 of the elongate pin 98 and the abutment 96. Thus, the spring exerts a force upon the elongate pin 98 which constantly biases it as it moves from its non-extended position to its extended position. Elongate pin 98 is retained within PVC tubing 92 by use of a T-pin 110 which is inserted through a pair of aligned holes 112 within PVC tubing 92. Thus, T-pin 110 retains the elongate pin 98 in its non-extended position until the closure piece, in which the pin assembly is cast, is ready to be permanently interconnected to adjacent barrier sections. When the closure piece is placed in assembled position and it is desired to obtain slideable movement of elongate pin 98 to its extended position, T-pin 110 is simply removed from its locked position within aligned holes 112 so that the biasing force exerted by spring 104 upon elongate pin 98 causes elongate pin 98 to slide within the passageway defined by PVC tubing 92.

The materials and size selected for spring 104 should be such that once it extends to a non-compressed state the elongate pin 98 is arranged in its fully extended position as shown in FIG. 8. At this time, approximately one-half of the overall length of elongate pin 98 should remain within PVC tubing 92 so that the other half of the length of elongate pins 98 can extend into an aligned female receptacle of an adjacent barrier section.

As further shown in FIG. 8, it may be desirable to provide one-half of the elongate pin 98 with a different color than the other half so that an inspector can verify that the pin has been correctly installed through an adjacent barrier section.

To complete proper interconnection of closure piece 64 to adjacent barrier sections such as first barrier section 10 and second barrier section 42, it may be desirable to fill nonoccupied space within passageways 82A, 81A, 80A, and 92 with a filler material designed to solidify therein. In this regard, a particularly desirable type of filler material is known as grout although other types of mortar and other filler materials can be utilized to assure that elongate pins are retained in their extended position to connect closure piece 64 with barrier section 10 and second barrier section 42.

The foregoing description of figures are directed towards the preferred embodiments in accordance with the present invention. However, it should be appreciated that numerous modifications can be made to each of the components of the pinning system of the present invention and in the method of assembling prefabricated barriers using such pinning system. Indeed, such modifications are encouraged to be made in the materials, structure, arrangement, and steps of the disclosed embodiments and methods of the present invention without departing from the spirit and scope of same. Thus, the foregoing description of the preferred embodiment should be taken by way of illustration rather than by way of limitation with respect to the present invention which is defined by the claims set forth below.

I claim:

1. A pinning system for use with prefabricated barriers comprising: barrier means for forming a barrier, said barrier means having an exterior surface defining an interior area and at least one precast passageway extending from said interior area to said exterior surface; and at least one pin assembly including at least one elongate pin having a predetermined length and being slideably arranged within said at least one passageway for selective movement between a non-extended position at which said at least one elongate pin is located at least substantially within said at least one precast passageway prior to placement of said barrier means next to an adjacent barrier means and an extended position at which a portion of said at least one elongate pin protrudes from said at least one passageway beyond said exterior surface, whereby said at least one elongate pin can be concurrently arranged within at least one aligned passageway of said adjacent barrier means so that corresponding portions of said predetermined length of said at least one elongate pin partially extend within said at least one passageway of said barrier means and within the at least one aligned passageway of the adjacent barrier means.

2. The pinning system of claim 1 wherein said barrier means comprises a jersey barrier having first and second ends adapted to be connected to adjacent jersey barriers, said at least one passageway extending within said jersey barrier from said interior area to at least one of said first and second ends.

3. The pinning system of claim 2 wherein said at least one pin assembly comprises a plurality of pin assemblies including a plurality of elongate pins, said at least one passageway comprising a plurality of passageways, each of said plurality of elongate pins being arranged in corresponding ones of said plurality of passageways.

4. The pinning system of claim 3 wherein each of said plurality of passageways define an axis extending therethrough, said plurality of pin assemblies further comprising a plurality of conduits arranged within corresponding ones of said plurality of passageways and extending coaxially therewith, said plurality of elongate pins being arranged within said plurality of conduits for selected slideable movement from said non-extended position to said extended position.

5. The pinning system of claim 3 wherein each of said plurality of passageways includes a first section extending between said exterior surface of said first end of said jersey barrier and said interior area thereof, said first section having an exterior end defining an aperture at said exterior surface of said first end of said jersey barrier and an interior end defining an opening at said interior area, each of said plurality of passageways further including a second section having an interior end connected to said interior end of said first section at a preselected location within said interior area of said jersey barrier and being arranged at an acute angle thereto to permit open communication between said first and second sections, said second section also having an exterior end defining an aperture at a preselected location on said external surface of said jersey barrier, said preselected location being arranged in a plane extending generally perpendicular to a plane which extends along the exterior surface of said first end of said jersey barrier, each of said plurality of elongate pins being arranged within corresponding first sections of said plurality of passageways for slideable movement from said non-extended position to said extended position.

6. The pinning system of claim 5 further comprising a first conduit arranged within each of said first sections and a second conduit arranged within each of said second sections, said plurality of elongate pins being arranged within corresponding ones of said first conduits for selective slideable movement from said non-extended position to said extended position.

7. The pinning system of claim 6 wherein said first and second conduits comprise PVC tubing.

8. The pinning system of claim 7 wherein said jersey barrier is made of concrete, said PVC tubing being cast within said concrete.

9. The pinning system of claim 8 further comprising connecting means arranged between said first and second conduits for connecting said first and second conduits at an acute angle with respect to each other.

10. The pinning system of claim 1 further comprising means for detecting whether said at least one elongate pin is in said extended or non-extended position.

11. The pinning system of claim 1 wherein said pin assembly further comprises restraining means for selectively retaining said at least one elongate pin in said non-extended position.

12. The pinning system of claim 11 wherein said pin assembly further comprises movement means for sliding said at least one elongate pin from said non-extended position to said extended position.

13. The pinning system of claim 12 wherein said movement means is adapted to automatically force said at least one elongate pin to slide from said non-extended position to said extended position.

14. The pinning system of claim 12 wherein said at least one passageway has an exterior end defining an aperture at said exterior surface of said barrier means and an interior end defining an abutment at a preselected location within said interior area of said barrier means, said movement means including spring means arranged between said abutment and said at least one elongate pin for continuously biasing said at least one elongate pin from said non-extended position to said extended position.

15. A pinning system for use with jersey barriers comprising: a closure piece having a first end adapted to be connected to a first adjacent jersey barrier and a second end adapted to be connected to a second adjacent jersey barrier, said closure piece being a custom-sized jersey barrier and including an exterior surface defining an interior area and a plurality of precast passageways extending from said interior area to said exterior surface at said first and second ends of said closure piece, each of said plurality of precast passageways including at least one external end defining an aperture at said exterior surface; and a plurality of pin assemblies including a plurality of elongate pins having a predetermined length and being slideably arranged within corresponding ones of said plurality of precast passageways prior to placement of said closure piece next to said first and second adjacent jersey barriers for selective movement between a non-extended position at which said plurality of elongate pins are located at least substantially within said at least one passageway and an extended position at which a portion of said plurality of elongate pins protrude from said at least one passageway beyond said exterior surface, said first and second adjacent jersey barriers having female receptacles aligned with said plurality of elongate pins and being adapted to receive said plurality of pins therein when said plurality of pins are arranged in said extended position so that said plurality of pins are concurrently disposed in said passageways of said closure piece and said female receptacles of said first and second adjacent jersey barriers.

16. The pinning system of claim 15 wherein each of said plurality of passageways includes a first section extending between one of said first or second ends of said closure piece and said interior area thereof, said first section having an exterior end defining an aperture at said exterior surface of said closure piece and an interior end defining an opening at said interior area, each of said plurality of passageways further including a second section having an interior end connected to said interior end of said first section at a preselected location within said interior area and being arranged at an acute angle with respect to said first section to permit open communication between said first and second sections, said second section also having an exterior end defining an aperture at a preselected location on said exterior surface of said closure piece, said preselected location being arranged in a plane extending generally perpendicular to a plane which extends along the exterior surface of said first or second ends of said closure piece, said plurality of elongate pins being arranged within corresponding first sections of said plurality of passageways for slideable movement from said non-extended position to said extended position.

17. The pinning system of claim 16 further comprising a first conduit arranged within each of said first sections and a second conduit arranged within each of said second sections, said plurality of elongate pins being arranged within corresponding ones of said first conduits for selective slideable movement from said non-extended position to said extended position.

18. The pinning system of claim 17 wherein said first and second conduits comprise PVC tubing.

19. The pinning system of claim 18 wherein said jersey barrier is made of concrete, said PVC tubing being cast within said concrete.

20. The pinning system of claim 19 further comprising connecting means arranged between said first and second conduits for connecting said first and second conduits at an acute angle with respect to each other.

21. The pinning system of claim 15 further comprising means for detecting whether said at least one elongate pin is in said extended or non-extended position.

22. The pinning system of claim 15 wherein said pin assembly further comprises restraining means for selectively retaining said at least one elongate pin in said non-extended position.

23. The pinning system of claim 22 wherein said pin assembly further comprises movement means for sliding said at least one elongate pin from said non-extended position to said extended position.

24. The pinning system of claim 23 wherein said movement means is adapted to automatically force said at least one elongate pin to slide from said non-extended position to said extended position.

25. The pinning system of claim 23 wherein said at least one passageway has an exterior end defining an aperture at said exterior surface of said barrier means and an interior end defining an abutment at a preselected location within said interior area of said barrier means, said movement means including spring means arranged between said abutment and said at least one elongate pin for continuously biasing said at least one elongate pin from said non-extended position to said extended position.

26. A method of assembling prefabricated barriers comprising the steps of providing a plurality of at least similarly sized barriers having first and second ends and female receptacles arranged at the said first and second ends; arranging at least one of said similarly sized barriers at a preselected location to form a first barrier section; arranging at least one of said plurality of similarly sized barriers at a predetermined spaced distance from said first barrier section to form a second barrier section so that a predetermined space is left between said first and second barrier sections, said predetermined space being smaller than the length of one of said similarly sized barriers; providing a closure piece having a length substantially equivalent to the length of said predetermined space, and including passageways including apertures disposed on both ends of said closure piece and elongate pins slideably arranged within corresponding ones of said passageways; arranging said closure piece within said predetermined space so that said first and second barrier sections appear as one continuous barrier section, said elongate pins being arranged within said corresponding passageways of said closure piece prior to placement of said closure piece within said predetermined space between said first and second barrier sections; aligning said passageways on said ends of said closure piece with said female receptacles in said first and second ends of said first and second barrier sections; and sliding at least a portion of said elongate pins from said passageways within said closure piece until said elongate pins extend into said aligned female receptacles so that said closure piece is secured against lateral movement with respect with said first and second barrier sections.

27. A method of claim 26 wherein said elongate pins are concurrently disposed in said passageways and said female receptacles when arranged in assembled position.

28. The method of claim 27 wherein said step of sliding said elongate pins from said passageways of said closure piece into said aligned female receptacles of said first and second barrier sections includes the step of pushing said elongate pins into said female receptacles.

29. The method of claim 27 wherein said step of sliding said elongate pins from said passageways of said closure piece into said aligned female receptacles of said first and second barriers sections comprises the step of removing a restraining device from the apertures of said passageways so that corresponding spring means can automatically cause said elongate pins to slide into said female receptacles.

30. The method of claim 26 further comprising the step of flowing filler material into a portion of said passageways and thereafter permitting said filler material to harden so that corresponding pins will be secured in assembled position within said female receptacles.

31. The method of claim 30 wherein said filler material comprises grout.

32. The method of claim 26 wherein at least one of said similarly sized barriers has a centrally arranged throat portion adjacent the bottom thereof, said step of arranging at least one of said similarly sized barriers at a preselected location comprises placing said at least one barrier over a catch basin so that said throat portion is adjacent said catch basin.

33. The method of claim 32 wherein said second barrier section comprises a plurality of identically sized barriers arranged in an end-to-end relationship.

* * * * *

UNITED STATES PATENT AND TRADEMARK OFFICE

CERTIFICATE OF CORRECTION

PATENT NO. : 5,443,324

DATED : August 22, 1995

INVENTOR(S) : Keith D. Sullivan

It is certified that error appears in the above-identified patent and that said Letters Patent is hereby corrected as shown below:

Column 3, line 29, ".exterior" should read --exterior--.
Column 8, line 19, "my" should read --may--.
Column 10, line 58, "illustrate" should read --illustrated--.

Signed and Sealed this

Seventh Day of November, 1995

*Attest:*

Bruce Lehman

BRUCE LEHMAN

*Attesting Officer*

*Commissioner of Patents and Trademarks*